US008235101B2

(12) United States Patent
Taras et al.

(10) Patent No.: US 8,235,101 B2
(45) Date of Patent: Aug. 7, 2012

(54) PARALLEL FLOW HEAT EXCHANGER FOR HEAT PUMP APPLICATIONS

(75) Inventors: Michael F. Taras, Fayetteville, NY (US); Alexander Lifson, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 1223 days.

(21) Appl. No.: 11/794,773

(22) PCT Filed: Jan. 5, 2006

(86) PCT No.: PCT/US2006/000443

§ 371 (c)(1),
(2), (4) Date: Jul. 5, 2007

(87) PCT Pub. No.: WO2006/083484

PCT Pub. Date: Aug. 10, 2006

(65) Prior Publication Data

US 2008/0296005 A1 Dec. 4, 2008

Related U.S. Application Data

(60) Provisional application No. 60/649,382, filed on Feb. 2, 2005.

(51) Int. Cl.
*G05D 23/00* (2006.01)

(52) U.S. Cl. ..... 165/299; 165/101; 165/103; 165/174; 165/175; 62/238.7; 62/324.1; 62/324.6

(58) Field of Classification Search ..... 165/48.1, 165/58, 96, 97, 100, 101, 103, 173, 174, 165/175, 176, 299; 62/238.7, 324.1, 324.6
See application file for complete search history.

(56) References Cited

U.S. PATENT DOCUMENTS

| | | | | |
|---|---|---|---|---|
| 3,919,585 | A | 11/1975 | Schorr | |
| 4,483,156 | A | 11/1984 | Oudenhoven | |
| 5,101,640 | A | 4/1992 | Fukushima et al. | |
| 5,651,268 | A | 7/1997 | Aikawa et al. | |
| 5,826,649 | A | 10/1998 | Chapp et al. | |
| 6,363,965 | B1 * | 4/2002 | Carmack et al. | 62/324.6 |
| 7,472,744 | B2 * | 1/2009 | Gorbounov et al. | 165/178 |
| 7,527,089 | B2 * | 5/2009 | Gorbounov et al. | 165/174 |
| 7,562,697 | B2 * | 7/2009 | Gorbounov et al. | 165/174 |

FOREIGN PATENT DOCUMENTS

| | | | |
|---|---|---|---|
| DE | 3217836 | A1 | 11/1983 |
| EP | 0136042 | A2 | 4/1985 |

(Continued)

OTHER PUBLICATIONS

Extended European Search Report dated Jun. 23, 2010 (5 pgs.).

(Continued)

*Primary Examiner* — Ljiljana Ciric
(74) *Attorney, Agent, or Firm* — Cantor Colburn LLP

(57) ABSTRACT

A parallel flow heat exchanger system (10, 50, 100, 200) for heat pump applications in which single and multiple paths of variable length are established via flow control systems which also allow for refrigerant flow reversal within the parallel flow heat exchanger system (10, 50, 100, 200), while switching between cooling and heating modes of operation. Examples of flow control devices are an expansion device (80) and various check valves (70, 72, 74, 76). The parallel flow heat exchanger system may have converging or diverging flow circuits and may constitute a single-pass or a multi-pass evaporator together with and a multi-pass condenser.

30 Claims, 4 Drawing Sheets

FOREIGN PATENT DOCUMENTS

| | | |
|---|---|---|
| JP | 54000251 | 1/1979 |
| JP | 63143462 | 6/1988 |

OTHER PUBLICATIONS

International Search Report mailed Jun. 12, 2006 (1 pg.).

Written Opinion of the International Searching Authority mailed Jun. 12, 2006 (6 pgs.).

International Preliminary Report on Patentability mailed Mar. 16, 2007 (10 pgs.).

* cited by examiner

PARALLEL FLOW HEAT EXCHANGER FOR HEAT PUMP APPLICATIONS

CROSS-REFERENCE TO RELATED APPLICATION

Reference is made to and this application claims priority from and the benefit of U.S. Provisional Application Ser. No. 60/649,382, filed Feb. 2, 2005, and entitled PARALLEL FLOW HEAT EXCHANGERS FOR HEAT PUMP APPLICATIONS, which application is incorporated herein in its entirety by reference.

BACKGROUND OF THE INVENTION

This invention relates generally to refrigerant heat pump systems and, more particularly, to parallel flow heat exchangers thereof.

A definition of a so-called parallel flow heat exchanger is widely used in the air conditioning and refrigeration industry and designates a heat exchanger with a plurality of parallel passages, among which refrigerant is distributed and flown in the orientation generally substantially perpendicular to the refrigerant flow direction in the inlet and outlet manifolds. This definition is well adapted within the technical community and will be used throughout the text. Parallel flow heat exchangers started to gain popularity in the air conditioning installations but their application in the heat pump field is extremely limited for the reasons outlined below.

Refrigerant heat pump systems typically operate in either cooling or heating mode, depending on thermal load demands and environmental conditions. A conventional heat pump system includes a compressor, a flow control device such as a four-way reversing valve, an outdoor heat exchanger, an expansion device, and an indoor heat exchanger. The four-way reversing valve directs refrigerant flown out of a compressor discharge port to either outdoor or indoor heat exchanger as well as routes it back to a compressor suction port from another of these heat exchangers, while the heat pump system is operating in the cooling or heating mode respectively. In the cooling mode of operation, the refrigerant is compressed in the compressor, delivered downstream to a four-way reversing valve and then routed to the outdoor heat exchanger (a condenser in this case). In the condenser, heat is removed from the refrigerant during heat transfer interaction with a secondary fluid such as air, blown over the condenser external surfaces by an air-moving device such as fan. As a result, the refrigerant is desuperheated, condensed and typically subcooled. From the outdoor heat exchanger, the refrigerant flows through the expansion device, where it is expanded to a lower pressure and temperature, and then to an indoor heat exchanger (an evaporator in this case). In the evaporator, refrigerant, during heat transfer interaction, cools air (or other secondary fluid) delivered to a conditioned space by an air-moving device such as fan. While the refrigerant, that is evaporated and superheated, cools the air flowing over the indoor heat exchanger, typically, moisture is also taken out of the air stream, thus the air is dehumidified as well. From the indoor heat exchanger, the refrigerant, once again, passes through the four-way reversing valve and is returned to the compressor.

In the heating mode of operation, the refrigerant flow through the heat pump system is essentially reversed. The refrigerant flows from the compressor to the four-way reversing valve and is routed to the indoor heat exchanger. In the indoor heat exchanger, which now serves as a condenser, the heat is released to the air to be delivered to the indoor environment by the fan to heat the indoor environment. The desuperheated, condensed and typically subcooled refrigerant then flows through the expansion device and to the downstream outdoor heat exchanger, where heat is transferred from a relatively cold ambient environment to the refrigerant, which is evaporated and generally superheated. The refrigerant is then directed to the four-way reversing valve and is returned to the compressor.

As known to a person skilled in the art, a simplified operation of the basic heat pump system has been described above, and many variations and optional features can be incorporated into the heat pump schematics. For instance, separate expansion devices can be employed for the heating and cooling modes of operation or an economizer or reheat cycle can be integrated into a heat pump design. Further, with the introduction of natural refrigerants such as R744, the high pressure side heat exchanger can potentially operate in the supercritical region (above the critical point), and a single-phase refrigerant will be flowing through its heat exchange tube instead of predominantly two-phase fluid such as at subcritical conditions. In this case, the condenser becomes a single-phase cooler type heat exchanger.

As can be seen from a simplified description of the heat pump operation, both heat exchangers typically serve a double duty as a condenser and as an evaporator, depending on the mode of operation. Further, a refrigerant flow through the heat pump heat exchangers is typically reversed (unless specific piping arrangements are made) during aforementioned modes of operation. Consequently, heat exchanger and heat pump system designers face a challenge to optimize the heat exchanger circuiting configuration for performance in both cooling and heating modes of operation. This becomes a particularly difficult task, since an adequate balance between refrigerant heat transfer and pressure drop characteristics is to be maintained throughout the heat exchanger. Therefore, many heat pump heat exchanges are designed with an equal, although not optimal, number of straight-through circuits for both cooling and heating modes of operation.

In general, the more vapor is contained in the two-phase refrigerant mixture flowing through the heat exchanger and the higher refrigerant flow rate the larger number of parallel circuits is required for efficient heat exchanger operation. Thus, the efficient condensers typically incorporate converging circuits and efficient evaporators employ either straight-through or diverging circuits. In other words, the heat exchanger circuits are either combined or split at some intermediate locations along the refrigerant paths to accommodate the changes in the refrigerant density and improve characteristics of condensing or evaporating refrigerant flows respectively. In conventional plate-and-fin heat exchangers, such circuit alterations, along with the refrigerant flow direction reversal, can be accomplished by utilizing the tripods and intermediate manifolds, as known in the industry. In the parallel flow heat exchangers, due to the design particulars as well as manifold design and refrigerant distribution specifics, the number of parallel circuits can be altered only at the manifold locations, restricting heat exchanger design flexibility, especially in the heat pump applications. Consequently, implementation of a variable number of parallel circuits along the heat exchanger length as well as variable length circuits for cooling and heating modes of operation represent a significant obstacle for heat exchanger and heat pump system designers and is not known in the art of parallel flow heat exchangers.

Another challenge a heat exchanger designer faces is refrigerant maldistribution, especially pronounced in the refrigerant system evaporators. It causes significant evaporator and overall system performance degradation over a wide range of operating conditions. Maldistribution of refrigerant may occur due to differences in flow impedances within evaporator channels, non-uniform airflow distribution over external heat transfer surfaces, improper heat exchanger orientation or poor manifold and distribution system design. Maldistribution is particularly pronounced in parallel flow evaporators due to their specific design with respect to refrigerant routing to each refrigerant circuit. Attempts to eliminate or reduce the effects of this phenomenon on the performance of parallel flow evaporators have been made with little or no success. The primary reasons for such failures have generally been related to complexity and inefficiency of the proposed technique or prohibitively high cost of the solution.

In recent years, parallel flow heat exchangers, and brazed aluminum heat exchangers in particular, have received much attention and interest, not just in the automotive field but also in the heating, ventilation, air conditioning and refrigeration (HVAC&R) industry. The primary reasons for the employment of the parallel flow technology are related to its superior performance, high degree of compactness and enhanced resistance to corrosion. As mentioned above, in the heat pump systems, each parallel flow heat exchanger is utilized as both a condensers and an evaporator, depending on the mode of operation, and refrigerant maldistribution is one of the primary concerns and obstacles for the implementation of this technology in the evaporators of the heat pump systems.

Refrigerant maldistribution in parallel flow heat exchangers occurs because of unequal pressure drop inside the channels and in the inlet and outlet manifolds, as well as poor manifold and distribution system design. In the manifolds, the difference in length of refrigerant paths, phase separation and gravity are the primary factors responsible for maldistribution. Inside the heat exchanger channels, variations in the heat transfer rate, airflow distribution, manufacturing tolerances, and gravity are the dominant factors. Furthermore, the recent trend of the heat exchanger performance enhancement promoted miniaturization of its channels (so-called minichannels and microchannels), which in turn negatively impacted refrigerant distribution. Since it is extremely difficult to control all these factors, many of the previous attempts to manage refrigerant distribution, especially in parallel flow evaporators, have failed.

In the refrigerant systems utilizing parallel flow heat exchangers, the inlet and outlet manifolds or headers (these terms will be used interchangeably throughout the text) usually have a conventional cylindrical shape. When the two-phase flow enters the header, the vapor phase is usually separated from the liquid phase. Since both phases flow independently, refrigerant maldistribution tends to occur, potentially causing the two-phase (zero superheat) conditions at the exit of some heat transfer tubes and promoting flooding at the compressor suction that may quickly translate into the compressor damage.

Thus, a designer of parallel flow heat exchangers for the heat pump applications faces the following challenges: implementation of the variable length diverging and conversing circuits for improving performance characteristics in the heating and cooling modes of operation, handling the reversed flow and avoiding maldistribution (as well as and other reliability issues such as oil holdup). Therefore, there is a need for improved parallel flow heat exchanger hardware and heat pump system designs which address and overcome the challenges described above.

SUMMARY OF THE INVENTION

It is the object of the present invention to provide for a parallel flow heat exchanger construction which exhibits performance advantages, particularly in the heat pump installations, by employing converging and/or diverging circuits and consequently providing adequate balancing of refrigerant heat transfer and pressure drop characteristics. It is another object of the present invention to provide for a parallel flow heat exchanger system design incorporating variable length circuits, including the capability for a refrigerant flow reversal, to enhance heat pump system performance while switching between and operating in both cooling and heating modes.

In one embodiment, a heat exchanger system design includes a parallel flow heat exchanger having two refrigerant passes while operating as a condenser and a single refrigerant pass while operating as an evaporator. In the condenser operation, the refrigerant is delivered to an inlet manifold and distributed to a larger number of parallel heat exchange tubes in the first path, collected in the intermediate manifold and then delivered to the outlet manifold through a smaller remaining number of parallel heat exchange tubes as will be described in greater detail hereinafter. In the evaporator operation, by utilizing a check valve system and routing piping, the refrigerant flow through the parallel flow heat exchanger is reversed and arranged in a single-pass configuration, while a single expansion device is provided to expand refrigerant to a lower pressure and temperature upstream of the evaporator. Therefore, the aforementioned benefits of enhanced performance and improved reliability are achieved in both cooling and heating modes of operation due to an optimal balance between refrigerant heat transfer and pressure drop characteristics inside the heat exchange tubes.

In another embodiment, a heat exchanger system includes a separate intermediate manifold and a parallel flow heat exchanger operating as a three-pass condenser and a single-pass evaporator. Operation and obtained advantages of this system are analogous to the previous embodiment. Furthermore, multiple expansion devices are provided to avoid or diminish effects of refrigerant maldistribution.

In still another embodiment, a heat exchanger system incorporates a parallel flow heat exchanger having three passes in the condenser operation while having only a single pass in the evaporator duty. This embodiment includes a single expansion device and a distributor system that can improve refrigerant distribution as well.

BRIEF DESCRIPTION OF THE DRAWINGS

For a further understanding of the objects of the invention, reference will be made to the following detailed description of the invention which is to be read in connection with the accompanying drawing, where.

DESCRIPTION OF THE PREFERRED EMBODIMENT

Figure 1A:
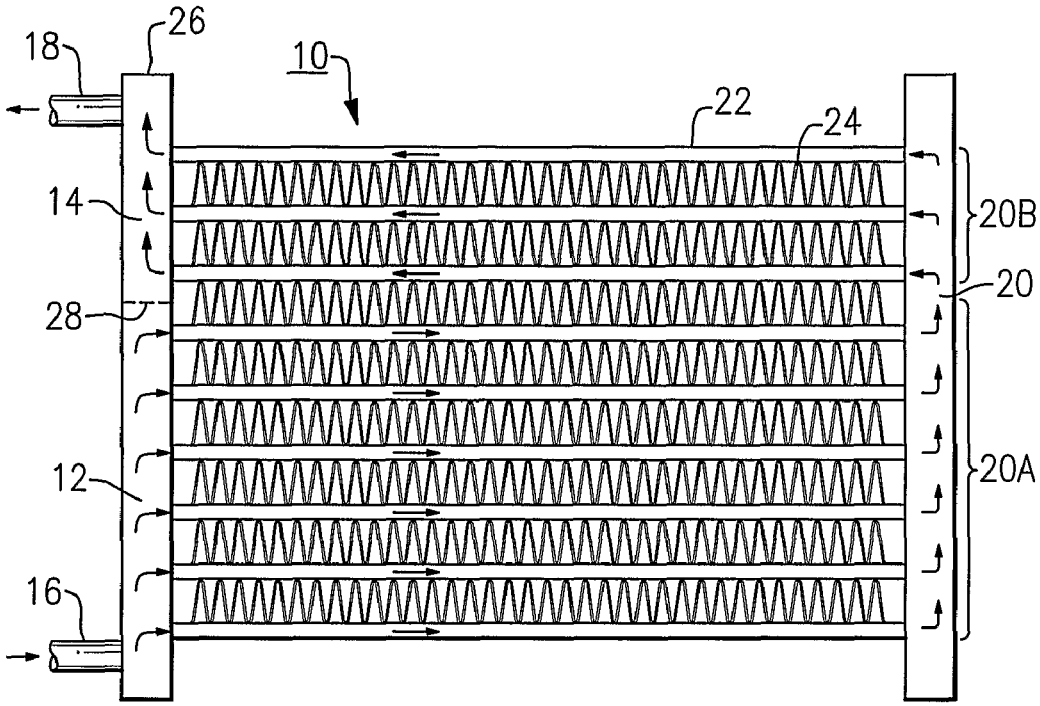
FIG. 1A is a schematic illustration of a parallel flow heat exchanger adapted for two-pass condenser applications.

In the operation of a conventional parallel flow heat exchanger, refrigerant flows through the inlet opening and into the internal cavity of an inlet manifold. From the inlet manifold, the refrigerant, in a single-pass configuration, enters and passes through a series of parallel heat transfer tubes to the internal cavity of an outlet manifold. Externally to the tubes, air is circulated over the heat exchange tubes and associated airside fins by an air-moving device such as fan, so that heat transfer interaction occurs between the air flowing outside the heat transfer tubes and refrigerant inside the tubes. The heat exchange tubes can be hollow or have internal enhancements such as ribs for structural rigidity and heat transfer augmentation. These internal enhancements divide each heat exchange tube into multiple channels along which the refrigerant is flown in a parallel manner. The channels typically have circular, rectangular, triangular, trapezoidal or any other feasible cross-section. Furthermore, the heat transfer tubes can be of any cross-section, but preferably are either predominantly rectangular or oval. The heat exchanger elements are usually made from aluminum and attached to each other during furnace brazing operations.

In a multi-pass arrangement, the heat transfer tubes are divided into tube banks and the refrigerant is flown from one tube bank to another in a parallel manner through a number of intermediate manifolds or manifold chambers associated with inlet and outlet manifolds. A number of heat transfer tubes in each tube bank can be varied based on performance and reliability requirements.

As mentioned above, in general, the more vapor is contained in the two-phase refrigerant mixture flowing through the heat exchanger and the higher refrigerant flow rate the larger number of parallel circuits is required for efficient heat exchanger operation. Thus, the condensers typically incorporate converging circuits and evaporators employ either straight-through or diverging circuits. In other words, a number of parallel heat exchanger circuits is altered at the intermediate manifold locations to accommodate the changes in refrigerant density and improve characteristics (balance the heat transfer and pressure drop) of condensing or evaporating refrigerant flows.

As also explained above, in the heat pump operation, each heat exchanger typically serves a double duty as a condenser and as an evaporator, depending on the mode of operation (cooling or heating). Further, the refrigerant flow through the heat pump heat exchangers is typically reversed during aforementioned modes of operation. Consequently, heat exchanger and heat pump system designers face a challenge to optimize heat exchanger circuiting configuration for performance and reliability in both cooling and heating modes of operation. It becomes a particularly difficult task, since an adequate balance between refrigerant heat transfer and pressure drop characteristics is to be maintained throughout the heat exchanger at a variety of operating conditions. Therefore, many heat pump heat exchanges are designed with an equal, although not optimal, number of straight-through circuits for both cooling and heating modes of operation.

Figure 1B:
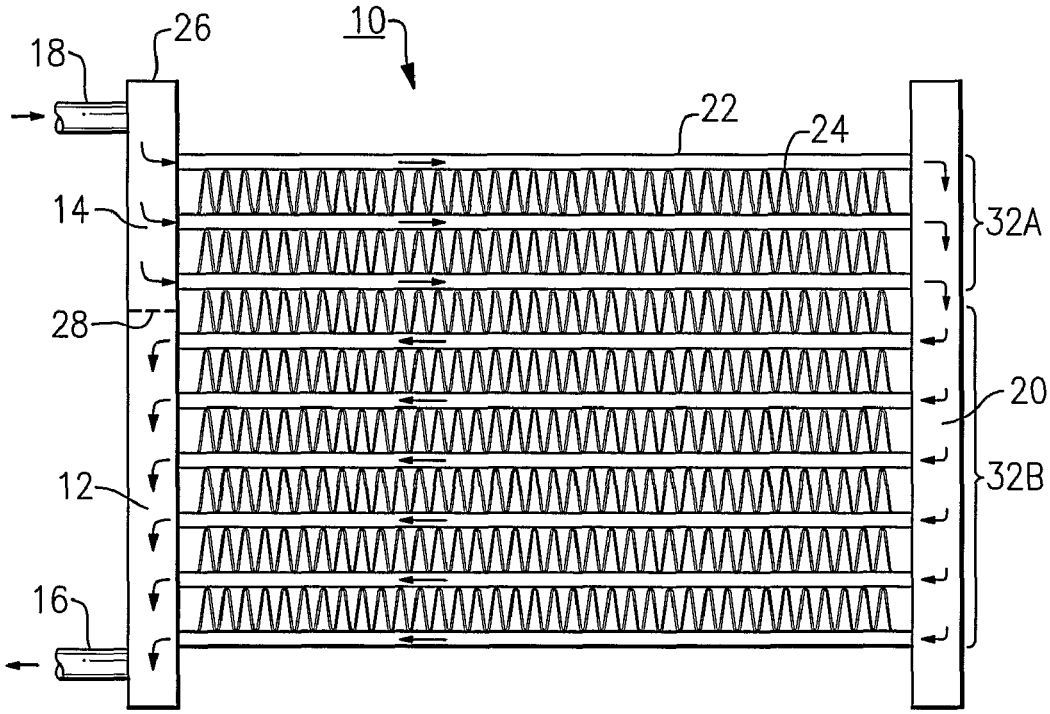
FIG. 1B is a view of FIG. 1A adapted for two-pass evaporator applications.

Referring now to FIGS. 1A and 1B, in one embodiment of the invention, a parallel flow heat exchanger 10 is shown to include an inlet header or manifold 12, and adjoining outlet header or manifold 14, and a plurality of parallel disposed heat exchange tubes 22 fluidly interconnecting the inlet manifold and the outlet manifold with an intermediate manifold 20 disposed on an opposite side of the heat exchanger 10. Typically, the inlet and outlet manifolds 12 and 14 are circular or rectangular in cross-section, and the heat exchange tubes 22 are tubes (or extrusions) of flattened or round shape. As mentioned above, the heat exchange tubes 22 normally have a plurality of internal and external heat transfer enhancement elements, such as fins. For instance, external fins 24, uniformly disposed therebetween for the enhancement of the heat exchange process and structural rigidity, are typically furnace-brazed. The heat transfer tubes 22 may also have internal heat transfer enhancements and structural elements dividing each tube into multiple channels among which the refrigerant is flown is a parallel manner. As known, these channels may be of a rectangular, circular, triangular, trapezoidal or any other feasible cross-section.

In the condenser operation, as shown in FIG. 1A, the refrigerant is delivered to the manifold 12 through a refrigerant line 16 positioned downstream of a four-way reversing valve (not shown) and distributed to a relatively large number of parallel heat exchange tubes in the first path or tube bank 22A (approximately ⅔ of the total number of tubes), collected in the intermediate manifold 20 and then delivered to the manifold 14 through a relatively small remaining number of parallel heat exchange tubes in the second path or tube bank 22B (approximately ⅓ of the total number of tubes). From the manifold 14 refrigerant flows out to a refrigerant line 18 communicating with a downstream expansion device of the heat pump system (not shown). During heat transfer interaction with the air blown over external heat transfer surfaces of the heat exchanger 10 by an air-moving device such as fan, the refrigerant is desuperheated and partially condensed in the first tube bank 22A and completely condensed and then subcooled in the second tube bank 22B. A smaller number of heat transfer tubes in the second bank reflects higher density refrigerant flowing through the bank and is needed to maintain an appropriate balance between refrigerant heat transfer and pressure drop characteristics. In this embodiment, manifolds 12 and 14 are adjacent, share the same general construction member 26 and are separated by a rigid partition 28.

In the evaporator operation, the refrigerant flow through the heat exchange tubes 22 is reversed (see FIG. 1B). In FIG. 1B, the parallel flow heat exchanger 10 has identical manifold construction to the FIG. 1A embodiment but a number of the parallel heat exchange tubes in the first pass or tube bank 32A is smaller now (approximately ⅓ of the total number of tubes) than a number of the parallel heat exchange tubes in the second pass or tube bank 32B (approximately ⅔ of the total number of tubes). In the evaporator operation, refrigerant is partially evaporated in the first pass 32A and completely evaporated and then superheated in the second pass 32B, once again, due to heat transfer interaction with the air blown over the heat exchanger external surfaces. Now, a larger of number of heat exchange tubes in the second bank (than in the first bank) reflects higher density refrigerant flowing through the bank and is desired to maintain an appropriate balance between refrigerant heat transfer and pressure drop characteristics.

Therefore, an appropriate split in a number of heat exchange tubes 22 into the first and second passes can be designed for optimal enhanced performance of the parallel flow heat exchanger 10 in both cooling and heating modes of operation of the heat pump system. It has to be noted, that although the orientation of the parallel flow heat exchanger 10 is shown horizontally, other orientations such as vertical or at an angle are also within the scope of the invention. Further, parallel flow heat exchanger 10 can be straight, as shown in FIGS. 1A and 1B or can be bent or otherwise formed into any desired shape.

Figure 2A:
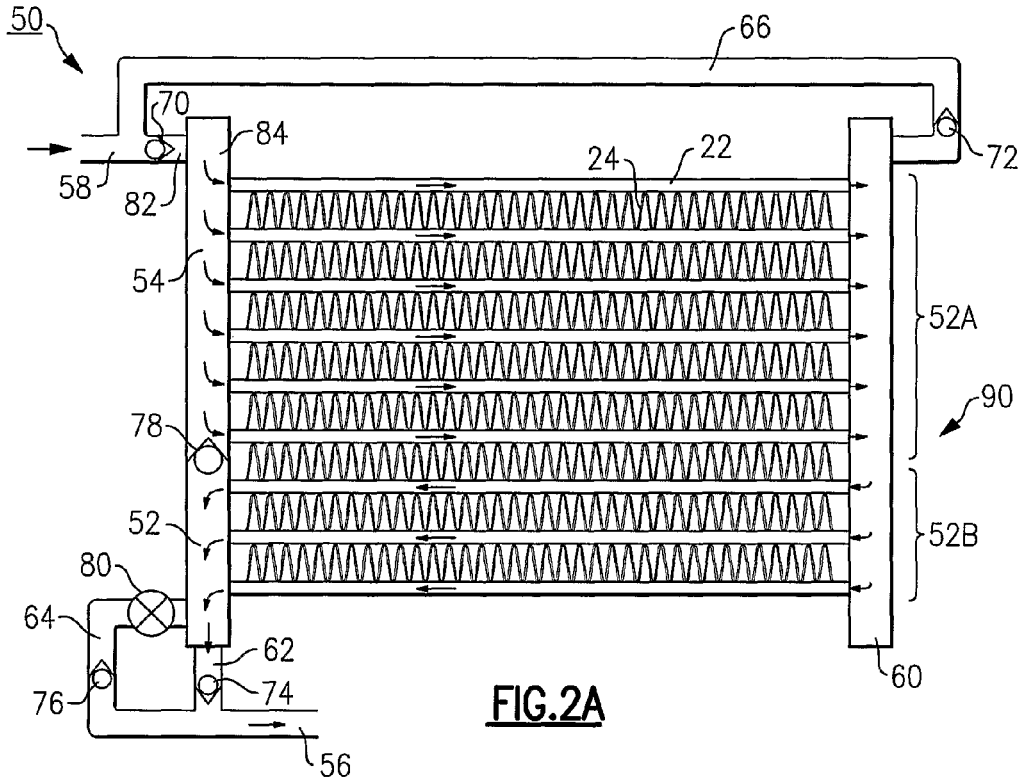
FIG. 2A is a schematic illustration of a second embodiment of a parallel flow heat exchanger system adapted for two-pass condenser applications.
Figure 2B:
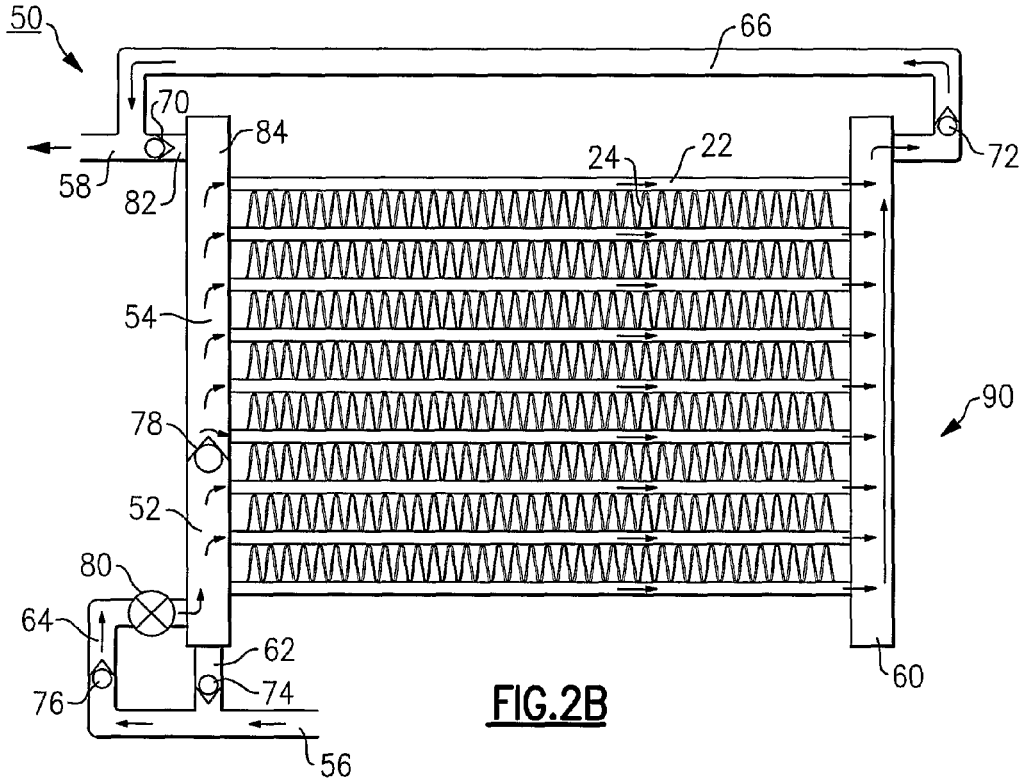
FIG. 2B is a view of FIG. 2A adapted for single-pass evaporator applications.

In the embodiments shown in FIGS. 2A and 2B, the heat exchanger system 50 includes a parallel flow heat exchanger 90 and an associated refrigerant flow control system. In the condenser operation depicted in FIG. 2A, the refrigerant enters the parallel flow heat exchanger 90 through a refrigerant line 58 and flows through a check valve 70, located on a refrigerant line 82, into a manifold 54, while a check valve 72 prevents refrigerant from immediately entering an intermediate manifold 60 through a refrigerant line 66. Thereafter, the refrigerant flows through a first pass or tube bank 52A containing a relatively large number of heat exchange tubes (approximately ⅔ of the total number of tubes), enters intermediate manifold 60 and is directed to a second pass or tube bank 52B containing a relatively small number of heat exchange tubes (approximately ⅓ of the total number of tubes). A higher pressure acting on an apposite side of the check valve 72 prevents the refrigerant flowing out of the intermediate manifold 60 from entering into the refrigerant line 66. In case there are any concerns regarding operation of the check valve 72, it can always be replaced with a solenoid valve. After leaving the second tube bank 52B, refrigerant is entering manifold 52, that shares the same general construction 84 with the manifold 54, and is leaving the manifold 52 through a refrigerant line 62 and a check valve 74 to be delivered to an expansion device through a refrigerant line 56. A check valve 76 positioned on a refrigerant line 64 prevents refrigerant flowing through an expansion device 80, in case separate expansion devices are utilized for cooling and heating modes of operation.

During heat transfer interaction with the air blown over external heat transfer surfaces of the heat exchanger 90 by an air-moving device, the refrigerant is desuperheated and partially condensed in the first tube bank 52A and completely condensed and then subcooled in the second tube bank 52B. Once again, a smaller number of heat transfer tubes in the second bank reflects higher density refrigerant flowing through the bank and is needed to maintain an appropriate balance between refrigerant heat transfer and pressure drop characteristics. In this embodiment, manifolds 52 and 54 are also adjacent, share the same general construction member 84 and are separated by a check valve 78. Once again, higher pressure acting on an opposite side of the check valve 78 prevents refrigerant from entering the manifold 54 from the manifold 52. The advantages similar to the benefits of the FIG. 1A embodiment are obtained here as well.

In the evaporator operation depicted in FIG. 2B, the refrigerant flows from the refrigerant line 56 into the refrigerant line 64 through the check valve 76 and expansion device 80, while the check valve 74 prevents the refrigerant to enter the refrigerant line 62 and to bypass the expansion device 80. In the expansion device 80, that can be of a fixed orifice type (e.g. a capillary tube, an accurator or an orifice) or a valve type (e.g. thermostatic expansion valve or electronic expansion valve), the refrigerant is expanded to a lower pressure and temperature and enters the manifolds 52 and 54 in a parallel manner, since the check valve 78 doesn't prevent refrigerant from entering the manifold 54 now. Form the manifolds 52 and 54, the refrigerant simultaneously flows through all heat exchange tubes 22 in a single-pass arrangement, enters manifold 60 and leaves the parallel flow evaporator 90 through the check valve 72 and refrigerant lines 66 and 58 to be delivered to the four-way reversing valve and returned to the compressor. The check valve 70, installed in the refrigerant line 82, prevents the refrigerant from immediately leaving the manifold 54 and parallel flow heat exchanger 90 without passing through the heat exchange tubes 22. As in the FIG. 1B embodiment, in the evaporator operation, refrigerant is evaporated and then superheated, although in a single pass, due to heat transfer interaction with the air blown over the heat exchanger external surfaces. Since in many cases, a higher number of refrigerant circuits is beneficial for the evaporator operation, a performance augmentation is achieved in the FIG. 2B embodiment. Therefore, variable length refrigerant circuits provided for the parallel flow heat exchanger system 50 assure optimal enhanced performance in both cooling and heating modes of operation of the heat pump system. Also, it has to be noted that if the expansion device 80 is of an electronic type, then the check valve 76 is not required.

Figure 3A:
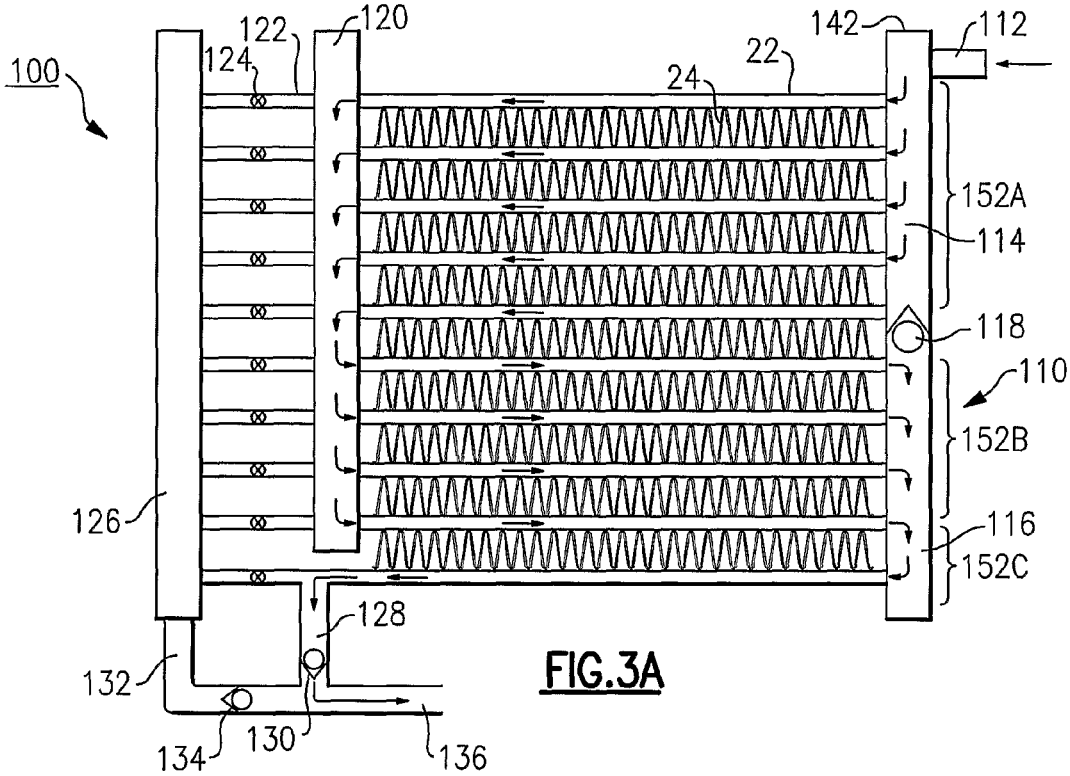
FIG. 3A is a schematic illustration of a third embodiment of a parallel flow heat exchanger system adapted for three-pass condenser applications.
Figure 3B:
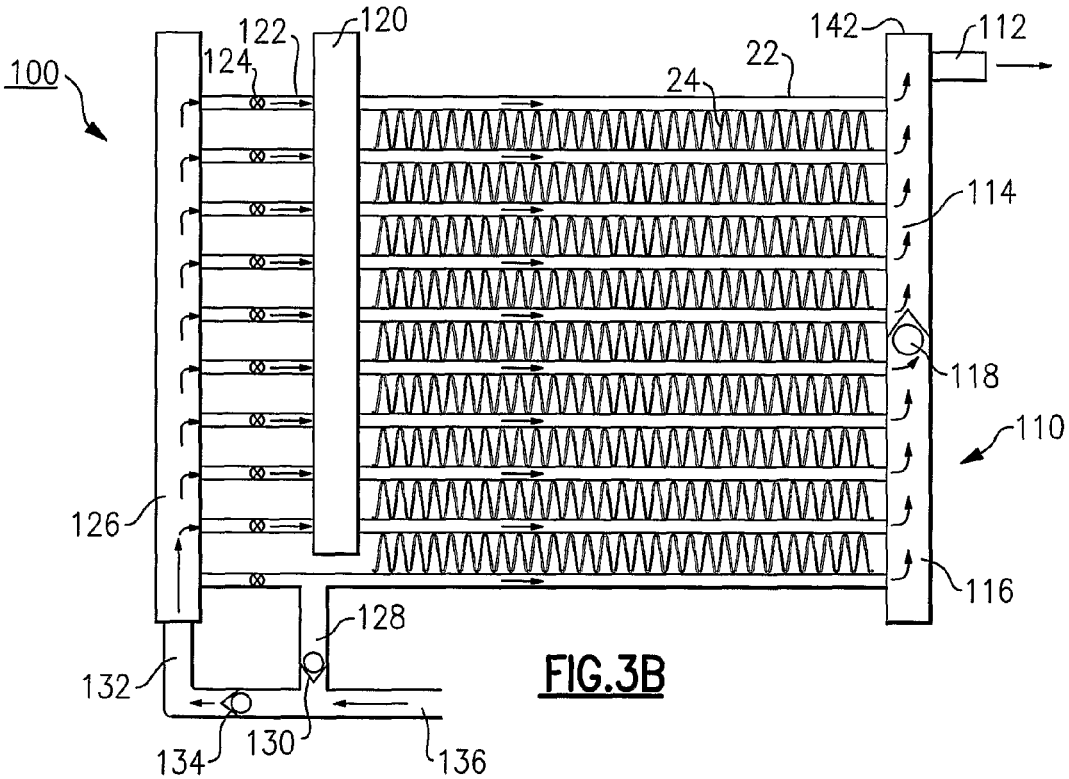
FIG. 3B is a view of FIG. 3Aa adapted for single-pass evaporator applications.

In the embodiments shown in FIGS. 3A and 3B, the heat exchanger system 100 includes a parallel flow heat exchanger 110 and an associated refrigerant flow control system. In the condenser operation depicted in FIG. 3A, the refrigerant enters the parallel flow heat exchanger 110 through a refrigerant line 112 and flows into a manifold 114, while a check valve 118 prevents refrigerant from immediately entering an intermediate manifold 116. Thereafter, the refrigerant flows through a first pass or tube bank 152A containing a relatively large number of heat exchange tubes, enters intermediate manifold 120 and is directed to a second pass or tube bank 152B containing a smaller number of heat exchange tubes. A higher pressure acting on an apposite side of the check valve 118 prevents the refrigerant flowing out of the intermediate manifold 116 from re-entering the manifold 114. After leaving the second tube bank 152B, refrigerant enters a third pass or tube bank 152C containing even smaller number of heat exchange tubes and is directed through a refrigerant line 128 and a check valve 130 to be delivered to an expansion device through a refrigerant line 136. A check valve 134 positioned on a refrigerant line 132 prevents refrigerant from flowing through expansion devices 124, in case there is a concern that the expansion devices 124 themselves will not create high enough hydraulic resistance to refrigerant flow. Thus, in some situations, the check valve 134 may not be required. Analogously, the high hydraulic resistance created by the expansion devices 124 predominantly prevents refrigerant flow communication between manifolds 120 and 126.

As before, during heat transfer interaction with the air blown over external heat transfer surfaces of the heat exchanger 110 by an air-moving device, the refrigerant is desuperheated and partially condensed in the first tube bank 152A, completely (or almost completely) condensed in the second tube bank 152B and then subcooled in the third tube bank 152C. Once again, a progressively smaller number of heat exchange tubes in the second and third tube banks reflects higher density refrigerant flowing through the bank and is needed to maintain an appropriate balance between refrigerant heat transfer and pressure drop characteristics. Similarly, a higher number of refrigerant passes in the condenser operation can be implemented if desired.

In the evaporator operation depicted in FIG. 3B, the refrigerant flows from the refrigerant line 136 into the refrigerant line 132 through the check valve 134 and into the manifold 126 to be distributed among the expansion devices 124 positioned on connecting lines 122, while the check valve 130 prevents the refrigerant from entering the refrigerant line 128 and to bypass the expansion devices 124. In the expansion devices 124, that are typically of a fixed orifice type (e.g. a capillary tube, an accurator or an orifice), the refrigerant is expanded to a lower pressure and temperature and enters the manifold 120 and all the heat exchange tubes 22 in a parallel manner, since the check valve 118 doesn't prevent direct refrigerant flow communication between the manifolds 114 and 116. The refrigerant simultaneously flows through all heat exchange tubes 22 in a single-pass arrangement, enters manifold 114 and 116 and leaves the parallel flow evaporator 110 through the refrigerant line 112. As in the FIG. 2B embodiment, in the evaporator operation, refrigerant is evaporated and then superheated in a single pass, due to heat transfer interaction with the air blown over the heat exchanger external surfaces. Once again, in many cases, a higher number of refrigerant circuits is beneficial for the evaporator operation, and a performance augmentation is achieved in the FIG. 3B embodiment. Therefore, variable length refrigerant circuits provided for the parallel flow heat exchanger system 100 assure optimal enhanced performance in both cooling and heating modes of operation of the heat pump system.

Additionally, the connecting lines 122 may be installed to penetrate inside the intermediate manifold 120 to face the opposite ends of the heat exchange tubes 22 defining relatively narrow gaps between the heat exchange tubes 22 and connecting lines 122. These narrow gaps improve refrigerant distribution in the evaporator operation and may be uniform for all the heat exchange tubes 22 or alternatively may change from one heat exchange tube to another or from one heat exchange tube section to another, depending on the heat exchanger design and application constraints.

Figure 4A:
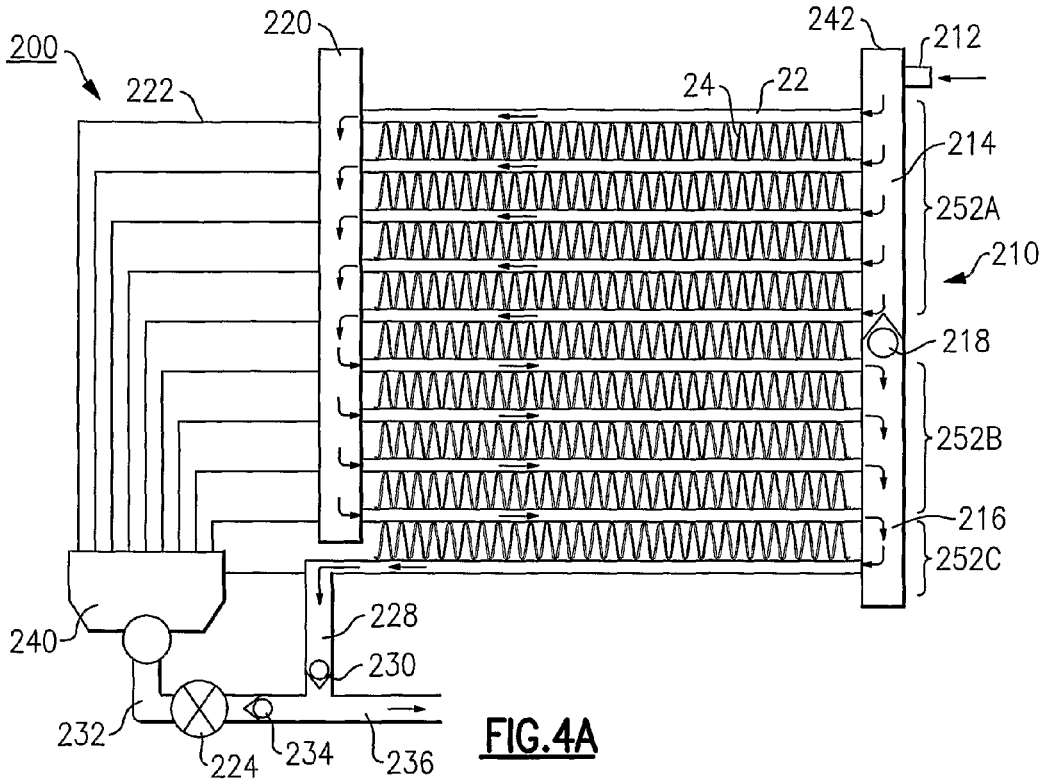
FIG. 4A is a schematic illustration of a fourth embodiment of a parallel flow heat exchanger system of the present invention adapted for three-pass condenser applications.
Figure 4B:
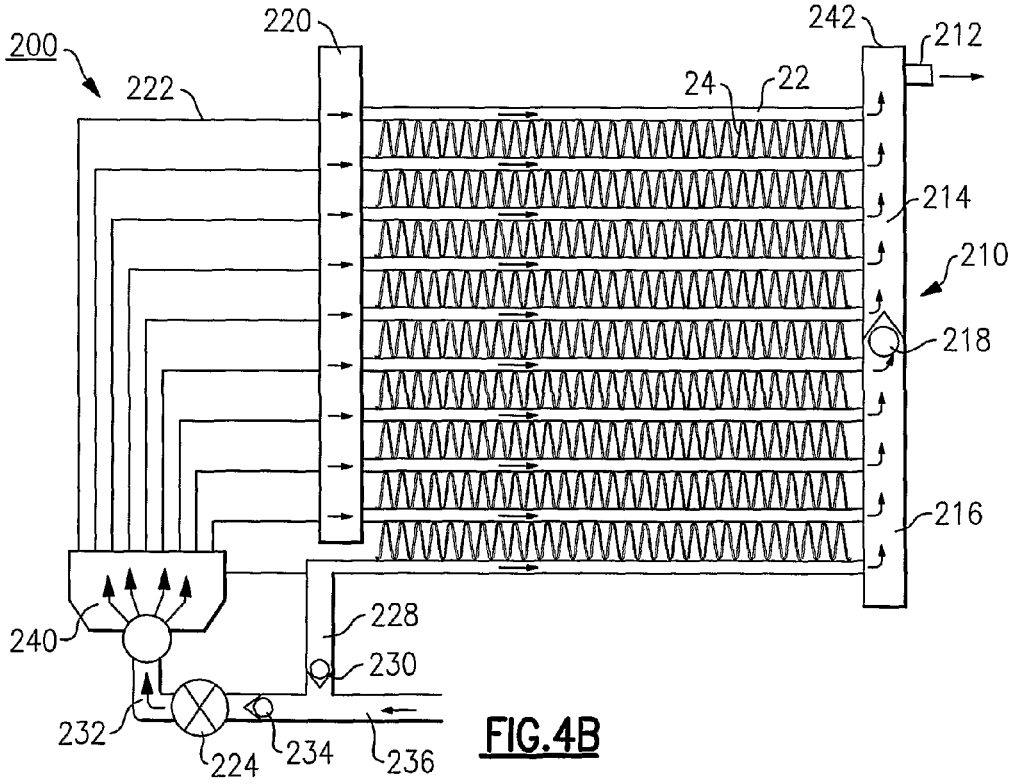
FIG. 4B is a view of FIG. 4A adapted for single-pass evaporator applications.

In the embodiments shown in FIGS. 4A and 4B, the heat exchanger system 200 includes a parallel flow heat exchanger 210 and an associated refrigerant flow control system. In the condenser operation depicted in FIG. 4A, the refrigerant enters the parallel flow heat exchanger 210 through a refrigerant line 212 and flows into a manifold 214. A check valve 218 prevents refrigerant from immediately entering an intermediate manifold 216. Thereafter, the refrigerant flows through a first pass or tube bank 252A containing a relatively large number of heat exchange tubes, enters an intermediate manifold 220 and is directed to a second pass or tube bank 252B containing a smaller number of heat exchange tubes. A higher pressure acting on an opposite side of the check valve 218 prevents the refrigerant from re-entering the manifold 214 from the manifold 216. After leaving the second tube bank 252B and the manifold 216, refrigerant enters a third pass or tube bank 252C containing an even smaller number of tubes and then passes through a refrigerant line 228 and a check valve 230 to be delivered to a refrigerant line 236 and a downstream expansion device (in case separate expansion devices are utilized for heating and cooling operations). At the same time, a check valve 234 prevents refrigerant from flowing through a distribution device (or so-called distributor) 240, distributor tubes 222, refrigerant line 232 and an expansion device 224. As before, if the expansion device 224 is of electronic type, then the check valve 234 may not be required.

As before, during heat transfer interaction with the air blown over external heat transfer surfaces of the heat exchanger 210 by an air-moving device, the refrigerant is desuperheated and partially condensed in the first tube bank 252A, completely (or almost completely) condensed in the second tube bank 252B and then subcooled in the third tube bank 252C. Once again, a progressively smaller number of heat exchange tubes in the second and third tube banks reflects higher density refrigerant flowing through the bank and is needed to maintain an appropriate balance between refrigerant heat transfer and pressure drop characteristics. As noted above, a higher number of refrigerant passes in the condenser operation can be implemented if desired.

In the evaporator operation depicted in FIG. 4B, the refrigerant flows from the refrigerant line 236 through the check valve 234 and the expansion device 224, through the refrigerant line 232 and to the distributor 240. From the distributor 240 the refrigerant is simultaneously distributed between the distributor tubes 222 to be delivered to the manifold 220 and through all the heat exchange tubes 22 in a single-pass arrangement. Thereafter, the refrigerant simultaneously enters the manifolds 214 and 216 directly fluidly connected to each other (since the refrigerant flows through the check valve 218 in an opposite direction now) and leaves the parallel flow evaporator 210 through the refrigerant line 212. As in the FIG. 3B embodiment, in the evaporator operation, refrigerant is evaporated and then superheated in a single pass, due to heat transfer interaction with the air blown over the heat exchanger external surfaces. As was noted before, in many cases, a higher number of refrigerant circuits is beneficial for the evaporator operation, a performance augmentation is achieved in the FIG. 4B embodiment. Therefore, variable length refrigerant circuits provided for the parallel flow heat exchanger system 200 assure optimal enhanced performance in both cooling and heating modes of operation of the heat pump system.

Additionally, the distributor tubes 222 are preferably installed to penetrate inside the intermediate manifold 220 to face the opposite ends of the heat exchange tubes 22 forming relatively narrow gaps between the heat exchange tubes 22 and distributor tubes 222. These narrow gaps improve refrigerant distribution in the evaporator operation and may be uniform for all the heat exchange tubes 22 or alternatively may change from one heat exchange tube to another or from one heat exchange tube section to another, depending on the heat exchanger design and application constraints. In case refrigerant maldistribution is not a concern, the entire distribution system 240-222 can be eliminated, with the refrigerant line 232 extending directly to the manifold 220.

It has to be understood that that the presented schematics are exemplary and many arrangements and configurations are possible to achieve variable length circuits in cooling and heating modes of operation for the heat pump system with the parallel flow heat exchangers. Further, various multi-pass arrangements are feasible for the condenser and evaporator applications with the manifolds or manifold chambers positioned on the same or opposite sides of the parallel flow heat exchanger.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A heat exchanger system comprising:

a parallel flow heat exchanger including a plurality of heat exchange tubes aligned in substantially parallel relationship and fluidly connected by a manifold system and said parallel flow heat exchanger having a variable circuit configuration when the flow direction is reversed through the heat exchanger; and a flow control system comprising at least one flow control device to alter circuit configuration of said parallel flow heat exchanger when flow through the heat exchanger changes direction; and wherein said flow control system provides for variable circuit length when the flow direction is reversed through said parallel flow heat exchanger.

2. The system of claim 1 wherein said manifold system comprises more than two manifolds associated with at least one flow direction.

3. The system of claim 1 wherein at least one flow control device is an expansion device.

4. The system of claim 3 wherein said expansion device has a fixed orifice.

5. The system of claim 3 wherein said expansion device is a plurality of expansion devices.

6. The system of claim 5 wherein said plurality of expansion devices are of a fixed restriction type.

7. The system of claim 6 wherein plurality of expansion devices are selected from the group consisting of an orifice, a capillary tube and an accurator.

8. The system of claim 3 wherein said expansion device is a valve.

9. The system of claim 8 wherein said valve is a thermostatic expansion valve.

10. The system of claim 8 wherein said valve is electronically controlled.

11. The system of claim 1 wherein at least one flow control device is one of a check valve and a solenoid valve.

12. The system of claim 1 wherein at least two manifolds of said manifold system are chambers within a joint manifold structure.

13. The system of claim 12 wherein a check valve separates said at least two manifold chambers.

14. The system of claim 1 wherein at least one manifold of said manifold system is a separate manifold.

15. The system of claim 1 wherein said parallel flow heat exchanger is operated as an evaporator and as a condenser.

16. The system of claim 15 wherein expanded refrigerant lines for the evaporator operation penetrate inside the manifold chamber to face the heat exchange tubes and to form gaps in order to provide improved refrigerant distribution.

17. The system of claim 16 wherein said gaps are uniform for all said heat exchange tubes.

18. The system of claim 16 wherein said gaps are non-uniform to further improve refrigerant distribution.

19. The system of claim 15 wherein said parallel flow heat exchanger is operating as a single-pass evaporator and a multi-pass condenser.

20. The system of claim 19 wherein said condenser is a two-pass condenser.

21. The system of claim 19 wherein said condenser is a three-pass condenser.

22. The system of claim 19 wherein the number of condenser circuits is diverging.

23. The system of claim 15 wherein said parallel flow heat exchanger is operating as a multi-pass evaporator and a multi-pass condenser.

24. The system of claim 23 wherein the number of evaporator circuits is converging.

25. The system of claim 23 wherein the number of condenser circuits is diverging.

26. The system of claim 23 wherein said evaporator is a two-pass evaporator.

27. The system of claim 23 wherein said condenser is a two-pass condenser.

28. The system of claim 23 wherein said condenser is a three-pass condenser.

29. The system of claim 1 wherein the refrigerant is flown through said parallel flow heat exchanger in opposite directions for condenser operation and evaporator operation.

30. The system of claim 1 wherein said parallel flow heat exchanger is a component in a heat pump system.

* * * * *